United States Patent [19]

Beeley et al.

[11] Patent Number: 4,651,451

[45] Date of Patent: Mar. 24, 1987

[54] LIGHTWEIGHT SNOW COMPACTOR FOR SKI RUNS

[75] Inventors: Micheal G. Beeley; Bruce W. Blair, both of Logan, Utah

[73] Assignee: Logan Manufacturing Company, Logan, Utah

[21] Appl. No.: 699,175

[22] Filed: Feb. 7, 1985

[51] Int. Cl.[4] ..... A63C 19/10

[52] U.S. Cl. ..... 37/219; 37/233; 37/281; 15/236 R; 172/189

[58] Field of Search ..... 37/219, 221, 231–233, 37/141 R, 266, 258, 268–269; 172/72, 617, 445.1, 189, 193–194, 747, 199–200; 15/236 R, 93 R

[56] References Cited

U.S. PATENT DOCUMENTS

| | | | |
|---|---|---|---|
| 1,997,248 | 4/1935 | Densberger | 172/612 X |
| 3,666,020 | 5/1972 | Hess | 172/200 |
| 3,795,069 | 3/1974 | Cheney | 172/200 |
| 3,823,781 | 7/1974 | Check et al. | 172/200 |
| 3,884,498 | 5/1975 | Cote, Jr. | 272/189 X |
| 4,019,268 | 4/1977 | Waterman | 37/219 |
| 4,341,027 | 7/1982 | Rohner | 37/219 |
| 4,359,831 | 11/1982 | Beeley | 172/112 X |
| 4,479,312 | 10/1984 | Turgeon | 37/219 |

FOREIGN PATENT DOCUMENTS

| | | | |
|---|---|---|---|
| 2946796 | 5/1981 | Fed. Rep. of Germany | 37/219 |
| 788289 | 12/1957 | United Kingdom | 172/612 |

OTHER PUBLICATIONS

Falline Corp Publication, "Snow Texturing & Grooming Accessories", revised 9-5-84, 2 pages.

*Primary Examiner*—E. H. Eickholt

[57] ABSTRACT

A ski run snow preparation apparatus having a snow-contacting blade which flexes laterally to provide an arcuate snow-contacting surface. The blade is pivotally mounted to a frame which is adapted to be secured upon the towing mechanism of a suitable tracked vehicle. Also mounted upon the frame is a remotely controllable mechanism, including a pair of hydraulic motors, to adjust the tilt of the snow-contacting blade in relation to the snow surface. The blade may operate under its own weight and that of the towing mechanism, or may be forceably pressed into the snow, as by vehicle mounted hydraulic motors provided to raise and lower the towing mechanism.

17 Claims, 11 Drawing Figures

LIGHTWEIGHT SNOW COMPACTOR FOR SKI RUNS

BACKGROUND OF THE INVENTION

1. Field: The field of the invention is devices for preparing the snow of ski runs.

2. State of the Art: A large family of vehicle drawn implements for preparing the snow of ski runs have been developed. Principally, these include snow "tillers" having a rotating bar covered with radial snow-cutting teeth which chop, stir, and loosen the snow. Plow blades are of course used to reduce major hillocks, generally redistribute the snow across the run, fill large hollows and even move snow onto the run from neighboring areas. "Powder makers" generally employing perforated drums drawn rotatably over the snow, reduce surface lump snow to more true powder-like form. The remaining principal implement is called a snow "compactor". It is intended to consolidate snow upon the run, and to smooth and fill relatively minor hillocks and depressions to produce a generally compacted snow base upon the run, being however sufficiently loose upon the surface for enjoyable, relatively effortless skiing. Many other approaches to snow surface preparation have on occasion been used, although the above are the principal implements currently in use. These include agricultural type harrows and disks. Heavy bars or rollers have simply been dragged sideways along the run, as have even weighted canvases, and sections of chain-link fence. The canvas may have been the first utililization of a flexible sheet for snow surface treatment, but flexible elements are not uncomon. The above mentioned tiller, for example, typically employs a hood with a skirt with a narrow flexible resilient trailing member attached to its lowermost edge, with a rubberoid comb attached to ride resiliently upon the snow, responding to local variations in elevation of the snow surface. The elongate resilient member with comb is actually a compactor bar acting behind the tiller cutter bar upon the loose, rough snow created by the cutter bar. The tiller also typically utilizes flexible wings at the end of the cutter bars, which flexibly contact the snow to provide smooth transitions from the tilled path to the neighboring snow paths, each another flexible compactor bar, even if only a short one.

However, most prior art snow compactors are separate implements comprising a rigid elongate bar with a curved snow-contacting bottom wall. The compactor bars are typically mounted to swivel upon the vehicle tow mechanism so that some adjustment is provided to transverse variation in snow path contour. Some of these bars operate essentially under their own weight, while others are additionally pressed positively downward upon the snow with greater or less force by hydraulic cylinders or the like. Some have remotely controlled tilting mechanisms to adjust the angle between the compacting surface and the snow. These snow-compacting devices are unnecessarily heavy, restricting their usefullness especially on steep slopes. Because they are rigid and massive, they often do not adjust rapidly to variations in the snow surface, and therefore leave such surfaces less than smooth, and may be locally damaged by rocks and the like.

Some of these prior art rigid compactor bars also incorporate narrow flexible extensions of their trailing edges, to compensate somewhat for the above deficiencies. These flexible extension members are only a few inches wide and extend the full length of the bar, and generally incorporate a comb or the like at their trailing edge. Thus, the use of flexible snow-contacting members is also not new even with independent compactor units. See prior art FIG. 7. These prior art flexible members have been of sheet plastic and the like, conveyor type belting generally being utilized. While definitely flexible, they are also definitely resilient, and are stiff enough to bear positively, rather than limply, as canvas might, upon the snow.

Another snow path preparation implement comprises a lightweight plastic snow-contacting blade, essentially planar when not stressed. The leading edge of the blade is connected to an elongate rigid metallic bar, which is in turn secured to the vehicle towing mechanism. It is believed that the angle of attack of the blade with the snow may be adjusted prior to use, but that no remote control of blade angle is provided.

The blade is flexible and resilient, and curves substantially when it is drawn over the snow under its own weight, or under the urging of motors forcing the towing mechanism downward. The plastic compactor blade is essentially of constant section from trailing edge to leading edge, so that the curve is greatest at the leading portion near the rigid connecting member, and less pronounced over the trailing portion. Because of the limited elastic range and low elastic modulus typical of plastics, the blade must be quite thick and rigid to assure that neither the operating stress nor strain exceed the limits of the material. This not only limits the flexure of the blade lateral to its length, but also the local longitudinal or biaxial flexure of the trailing portion of the blade in response to irregularities in the snow surface. The elastic modulus and strain capability is sensitive to temperature, so that both flexibility and strength vary markedly with weather conditions. Also, the high elastic hysteresis and low fatigue resistance are not desirable where long operating life without permanent distortion or fracture is desired.

BRIEF SUMMARY OF THE INVENTION

With the foregoing in mind, the disadvantages in the prior art of ski run snow compacting devices are eliminated or substantially alleviated by the present compactor apparatus, which provides a highly flexible resilient blade, the snow contacting portion of which is constructed of thin sheets, preferably of stainless steel. The flexible blade is constructed with its leading portion having greater bending resistance than its trailing portion, to provide a more desirable flexed shape for compacting snow and to relieve any stress concentration at the leading edge, which is secured to an elongate rigid member substantially its full length. An associated blade tilting mechanism allows the operator to remotely adjust the angle between the blade and the surface of the snow. Because of the high modulus and high elastic range of the steel, thin sheets may be employed, and the blade still be forceably pressed onto the snow by gravity or by hydraulic means, so that the snow-contacting portion is substantially curved. By controlled tilting, and controlled vertical force, the area of snow contacted by the blade and the unit pressure of the blade upon the snow may be adjusted over a wide range. Also, because the trailing portion of the blade is of thin resilient sheet, it is very substantially flexible longitudinal to the blade, so that humps, hollows and such irregularities in the snow surface are conformed to and smoothed by the trailing edge, while the leading, more rigid portion more forceably levels hillocks and fills hollows. The blade may advantageously comprise an elongate backbone member the length of the blade, to which is secured a snow-contacting sheet at its leading edge, along with one or more stiffening sheets of lesser widths, to provide the desired increased bending resistance of the leading portion of the blade. Advantageously, the snow-contacting sheet may be extended at each end with a flexible plastic wing, as of belting material, to provide a nearly completely smooth surface transition at the sides of the snow path being compacted. Also, because of individual variations in the angle of the tow mechanism rear towing bar with the snow, it may be desirable to provide a permanent lateral curvature into the leading portion of the blade sheets, so that the basic angle with the snow approximates that most desired.

It is therefore an object of the invention to provide an improved lightweight ski run compactor having a laterally flexible snow-contacting blade which may be forceably pressed onto the snow to provide arcuate contact with the snow, and having provisions for remote adjustment of the angle between the blade and the snow. It is a further object to provide such a blade the trailing portion of which is longitudinally substantially flexible to conform to variations in the path being compacted.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
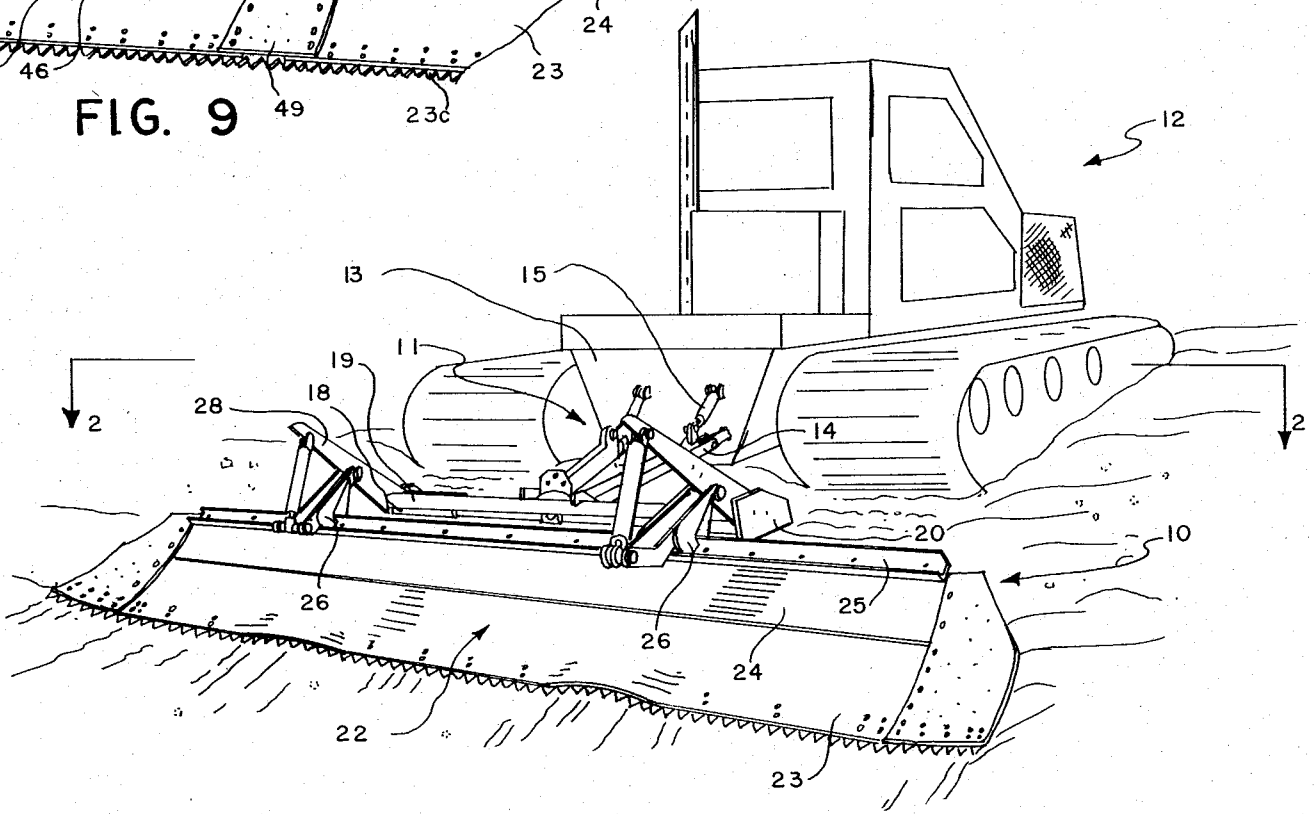
FIG. 1 is a perspective representation of the ski run snow compactor in accordance with the invention, illustrated as in use being towed by a suitable vehicle along a ski run, FIG. 2 an upper rear perspective drawing of the compactor of FIG. 1, taken along line 2—2 thereof, drawn to a slightly larger scale, FIG. 3 a vertical cross sectional view of the compactor of FIG. 2, taken along line 3—3 thereof, drawn to a somewhat enlarged scale, FIG. 4 the compactor of FIG. 3, drawn in position with a steep angle of attack with the snow, drawn to the same scale, FIG. 5 the compactor of FIG. 3 shown in carrying position with the blade thereof in unflexed condition, drawn to the same scale, FIG. 6 a cross sectional view of a fragmant of the compactor of FIG. 3, taken along line 6—6 thereof, drawn to a larger scale, FIG. 7 a vertical cross sectional view of a prior art ski run snow compactor bar, drawn to approximately the scale of FIG. 3, FIG. 8 a partial cross sectional view of the compactor of FIG. 2, along with the vehicle tow frame and hydraulic motors thereof, taken along line 8—8 of FIG. 2, drawn to a smaller scale than FIG. 2, FIG. 9 a perspective view of a fragment of another embodiment of the compactor of FIG. 1, showing a retractable extension wing therefor, FIG. 10 a compactor in accordance with FIG. 3, with the blade sheets thereof however constructed to be permanently curved backwardly over a leading portion thereof, drawn to the scale of FIG. 5, and FIG. 11 a compactor of FIG. 10, shown in operating position with the blade tilted at the same angle as in FIG. 3, drawn to the scale of FIG. 3.
Figure 5:
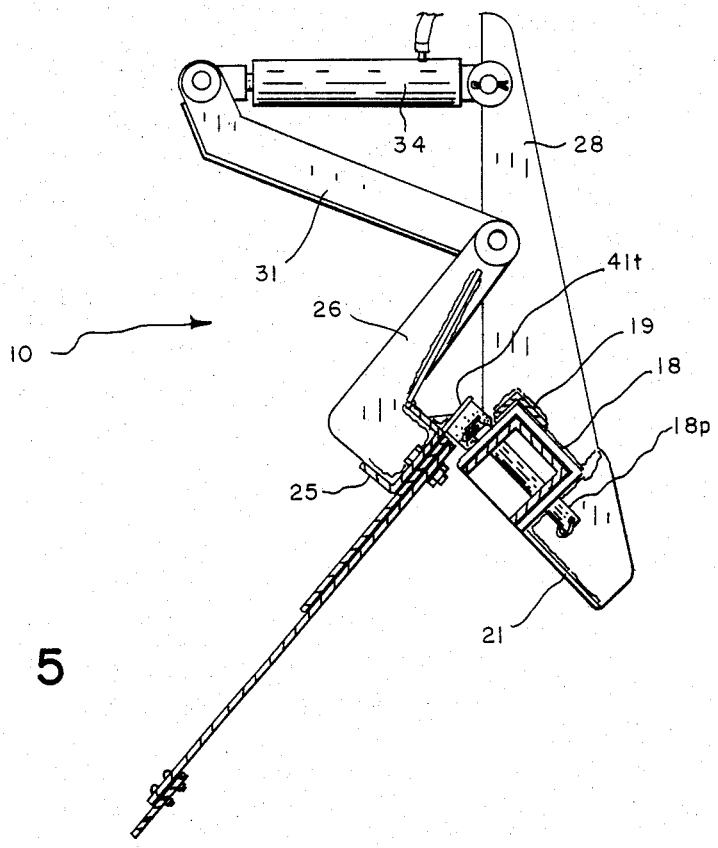

The adjustable pitch, laterally flexible ski run snow compactor 10 is shown in FIG. 1 in working condition attached to a tow bar assembly 11 of a tracked vehicle 12. Tow bar 11 is connected to the vehicle frame 13 through pivots 14, and may be raised and lowered by hydraulic cylinder and ram assemblies 15, acting between the vehicle frame and upstanding pivot plates 16 on each of its two side members 17. See also FIG. 8. Thus, compactor 10 may if desired be pressed forceably onto the surface of the snow by cylinder 15, or raised into carrying position. (FIG. 5)

Figure 2:
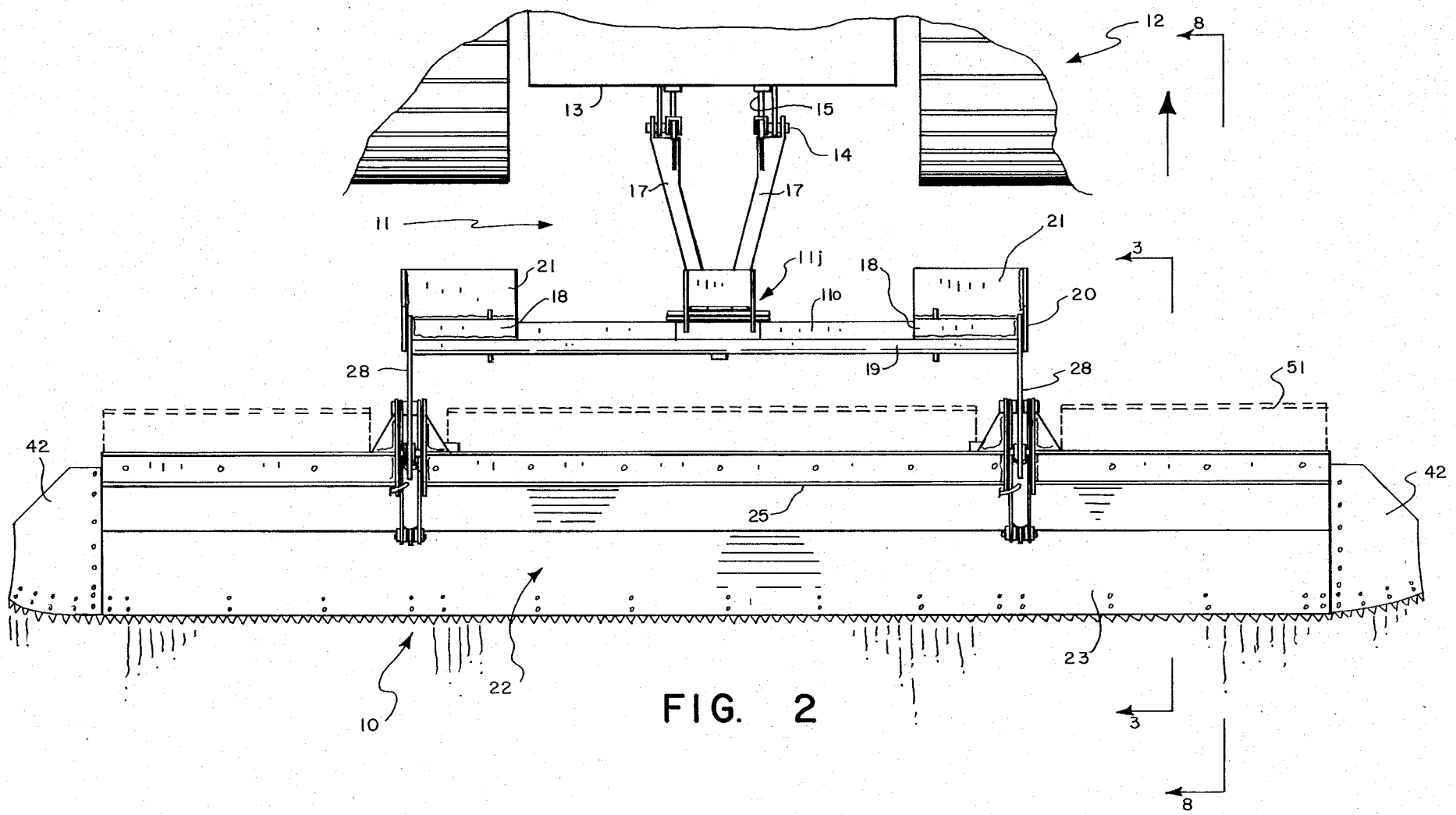
Figure 4:
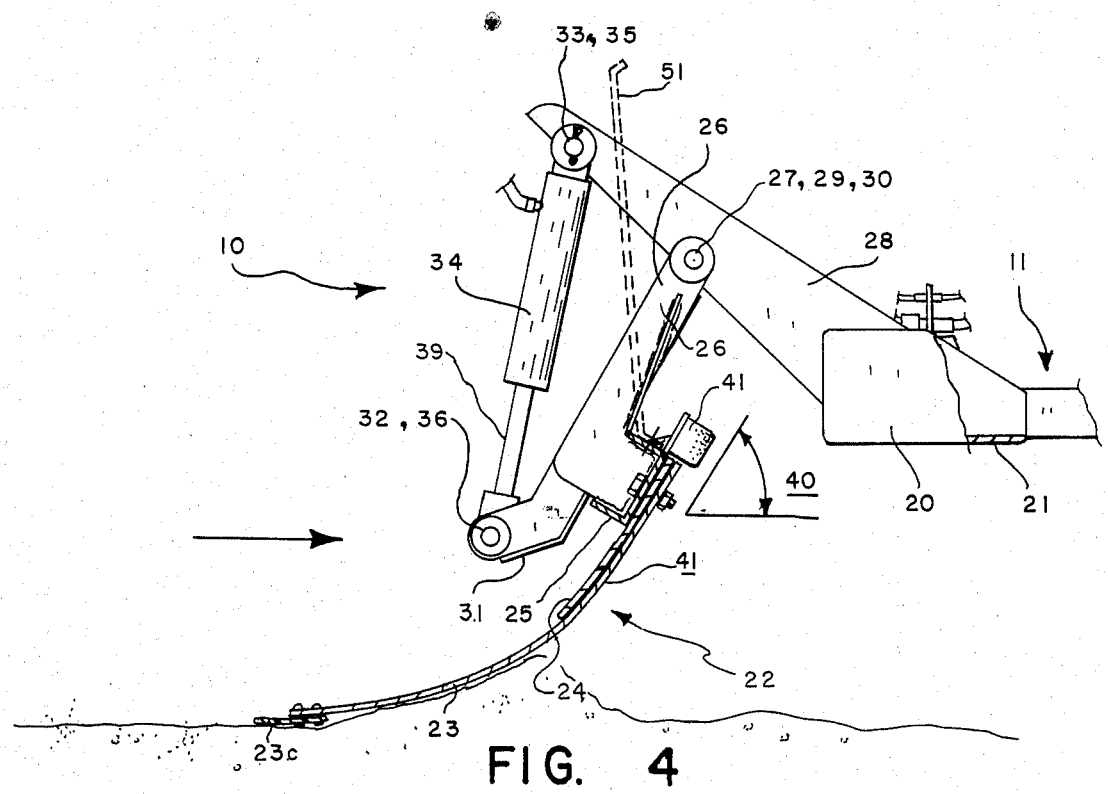

Snow compactor 10 is connected by pins **18*p* to tow bar 11 by way of oscillation bar 11*a* and swivel joint 11*j*, by inverted channel connectors 18, which are held spaced apart as by welding to the ends of an angle crossbar 19. Welded to each channel connector 18 is an end plate 20 and a "propping" plate 21, the latter being provided to support the compactor 10 in position for connection to tow bar 11. (FIGS. 2 and 4**)

Figure 6:
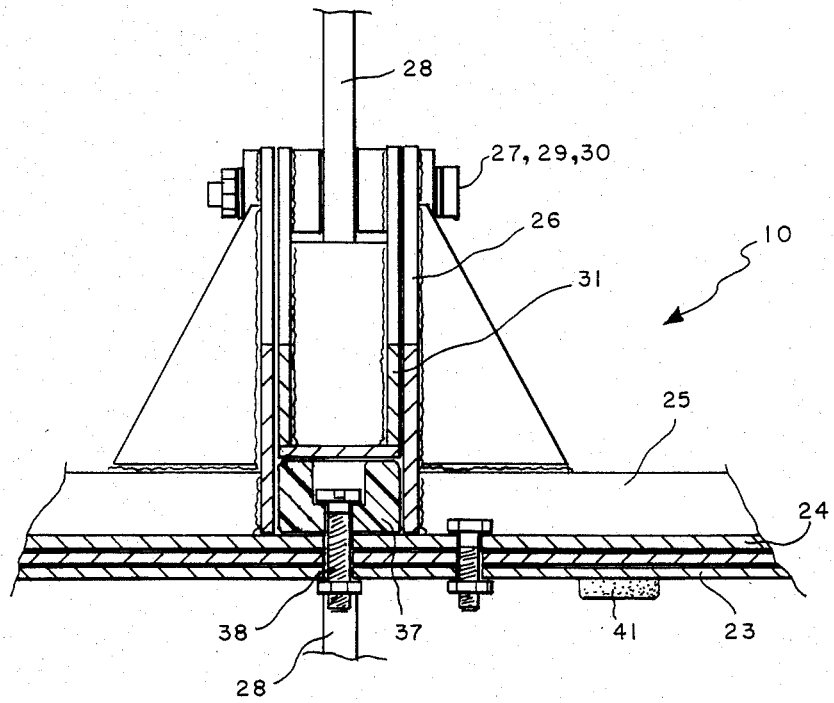

Snow-contacting blade assembly 22 of compactor 10 has a lowermost elongate steel sheet 23 and a narrower elongate upper sheet 24 of the same material. Both sheets are mounted at their leading edges to a blade stiffening channel 25. Blade assembly 22 has an elongate rigid sheet mounting channel 25, while thin sheets 23 and 24 are both quite flexible laterally. The trailing portion of sheet 23 is also very flexible in the longitudinal direction. A pair of spaced-apart blade assembly pivot arms 26 are welded to mounting channel 25, extending upwardly and forwardly. Each has a transverse pivot pin bore 27 at its distal end. A pair of pivot posts 28 project rearwardly upward from connector channels 18. A pivot bore 29, located intermediate to the ends of each pivot post 28, accepts a pivot pin 30 to connect the pivot arm 26. Also secured by pivot pins 30 is a pair of linkage members 31, each having at its opposite end a pivot bore 32. At the outermost end of each pivot post 28 is still another pivot bore 33. A pair of remotely controlled hydraulic cylinder and ram assemblies 34 are each secured by cylinder pivot pin 35 and ram pivot pin 36 at pivot bores 33 and 32, to act between pivot post 28 and linkage member 31. Blade adjusting linkage members 31 each rest upon a shock absorbing block 37 of resilient plastic secured as by bolt 38 to sheet mounting channel 25. (FIG. 6)

Figure 3:
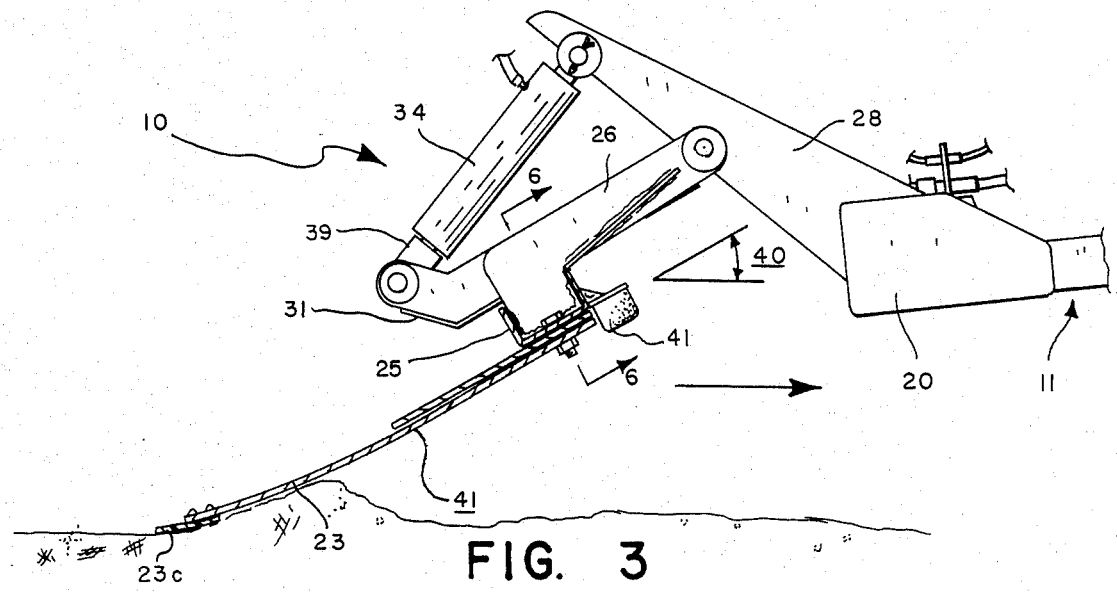

Extension of rams 39 exerts force downward upon shock absorbers 37, urging blade assembly 22 to rotate downward about pivot pins 30, increasing the angle 40 between the snow and the bottom surface 41 of sheet 23. (FIGS. 3 and 4) Retraction of rams 39 rotates blade 22 upwardly to be more nearly parallel to the snow. (FIG. 3) With rams 39 more fully extended, blade 22 is angled much more sharply with the surface of the snow. (FIG. 4)

When tow bar 11 is raised into compactor carrying position, blade 22, channel 25 and brackets 26 rotate to hang together on intermediate pivot pin 30. A pair of resilient bumpers 41 secured to a pair of tabs **41*t* welded to the foremost leg of sheet mounting channel 25, come to rest against the front surfaces of channel connectors 18. (FIG. 5**.)

Advantageously, a rubberoid wing 42 may be secured as by bolts 43 to each end of blade sheet 23 to avoid abrupt surface transition between the compacted path and the adjacent path on each side. Each wing 42 curves both in the direction of travel and perpendicularly upward thereto.

Figure 8:
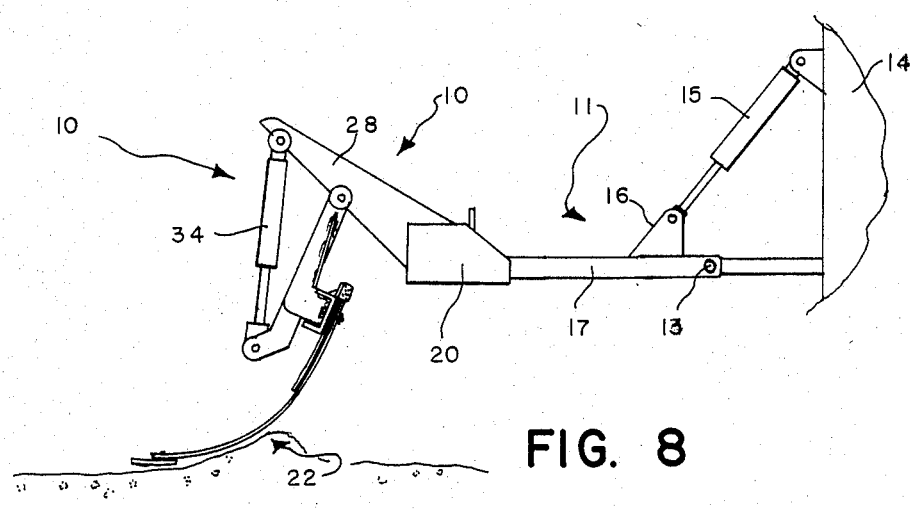

Shown conceptually in FIG. 8 is a fold-up extension wing assembly 44 which may be incorporated into blade assembly 22 to provide adjustment of path width. Extension steel sheets 45 and 46, along with the flexible wing 42, may be rotated about hinge 48 and "live" hinge sheet 49 to be lifted away from the snow by cylinder and ram assembly 50. Other wing retraction mechanisms may be employed, if further retraction is desired.

Also advantageously, snow-spillover deflector sheet 51 may be provided secured to compactor 10, e.g. to the forward edge of mounting channel 25 to prevent locally piled snow from falling over compactor blade 22 onto the freshly compacted path. See dashed lines, FIGS. 4 and 2. Deflector 52 may comprise a steel sheet, its upper edge folded for safety. However, a rubberoid sheet may instead be employed for the same purpose.

Figure 7:
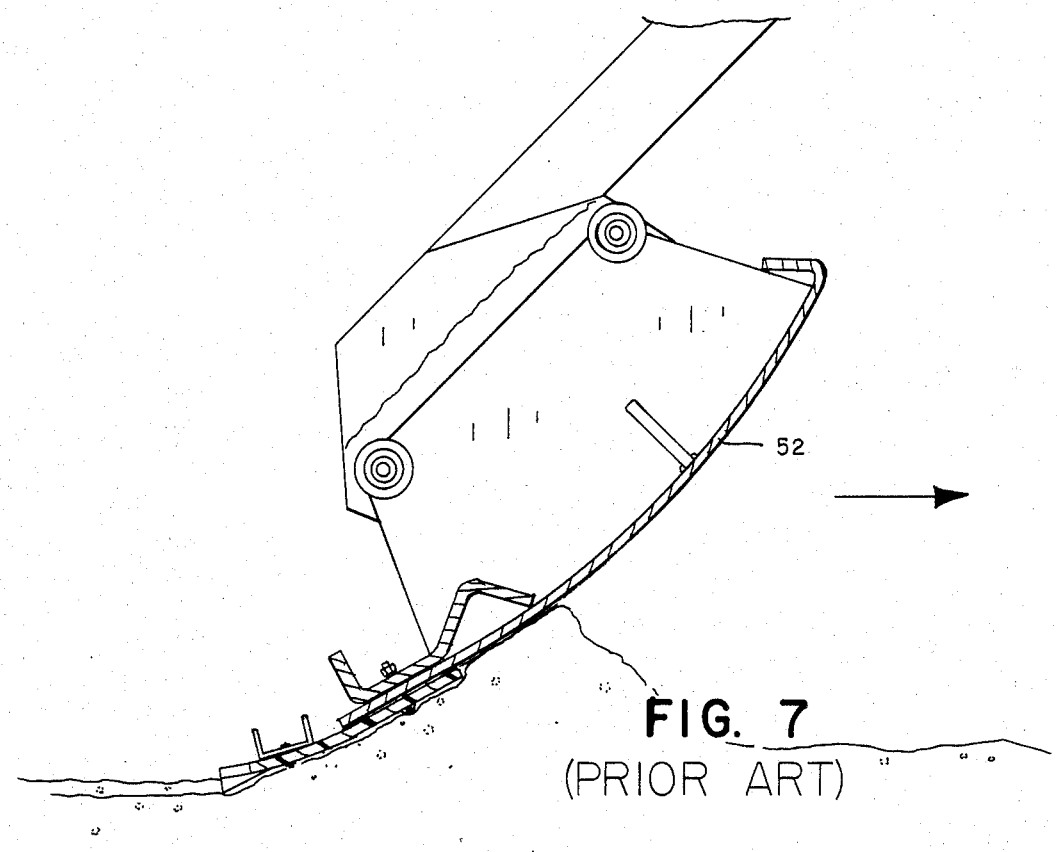
FIG. 7 (PRIOR ART)

The lateral flexibility of the blades 23 and 24, provides a curved snow-contacting surface of similar shape to that of prior art rigid compactor constructions. See prior art FIG. 7, showing a stiffened box compactor bar construction with a curved snow contacting bottom wall 52, and only a narrow flexible trailing member 53. However, the present construction, consisting largely of blade sheets 23 and 24, each approximately 1/16 inch in thickness, is much lighter, and other advantages derive from the lateral and longitudinal flexibility of blade 22.

Ski run snow, compactors level hillocks and fill surface depressions, pack the snow more densely to consolidate it upon the run, and desirably fluff a shallow layer on the surface to improve it for skiing. A relatively large angle between the blade and the snow is effective to knock down the hillocks and apply vertical pressure for packing. Leveling and fluffing is best accomplished by a shallow angle of attack, accompanied by less pressure. The flexible blade 22 tends to assume a shape having both characteristics, being more gently curved at the rear and much more sharply near the leading edge near channel 25. Upper sheet 24 relieves stress concentration at juncture of the blade sheets with mounting channel 25, and prevents excessive forward curvature. The blade flexibility also assures continued firm contact with the snow, by immediately adjusting for minor irregularities in the snow surface. The biaxial (lateral and longitudinal) resilient flexibility of the thin sheet trailing portion of blade 23 provides very desirable adjustment to surface variations across the path. (See FIG. 1) Of course, other combinations of snow-contacting and stiffening sheets besides that illustrated may be equally or more effective, such as two or more stiffening sheets, with different thicknesses and widths, to mention only one possibility.

Figure 9:
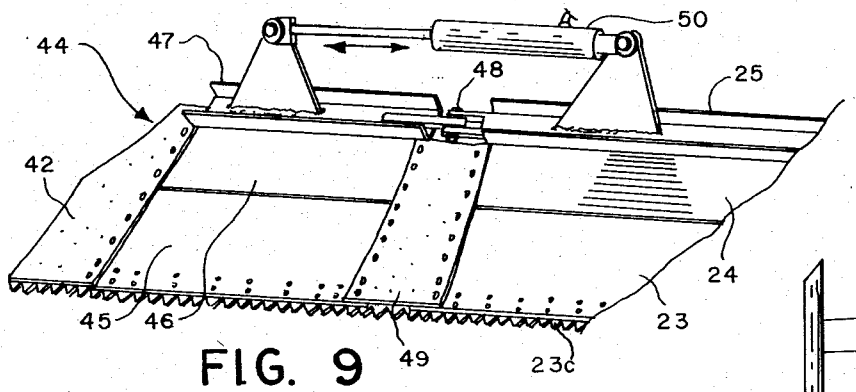

Tilting of blades 22 by operation of hydraulic cylinders 34 and linkages 31 adjusts the blade angle 40 to varying snow conditions. Generally, flattening the blade 22 upon the snow decreases the unit pressure, to more gently compact and smooth the snow. (FIG. 3) When the snow is heavier, for example, more unit pressure might be desirable, and a sharper angle of attack is then employed for compacting, with blade 22 angled more steeply with the snow. (FIG. 4) When used with towing mechanisms 11 which are mounted freely pivotal to the vehicle 12, the total vertical force upon the snow may be limited to that derived from the weight of the compactor and the pivoted towing mechanism. With tow bars 11 as illustrated, the two-way lifting cylinders 15 may be used to exert additional vertical force. (FIG. 9)

Figure 11:
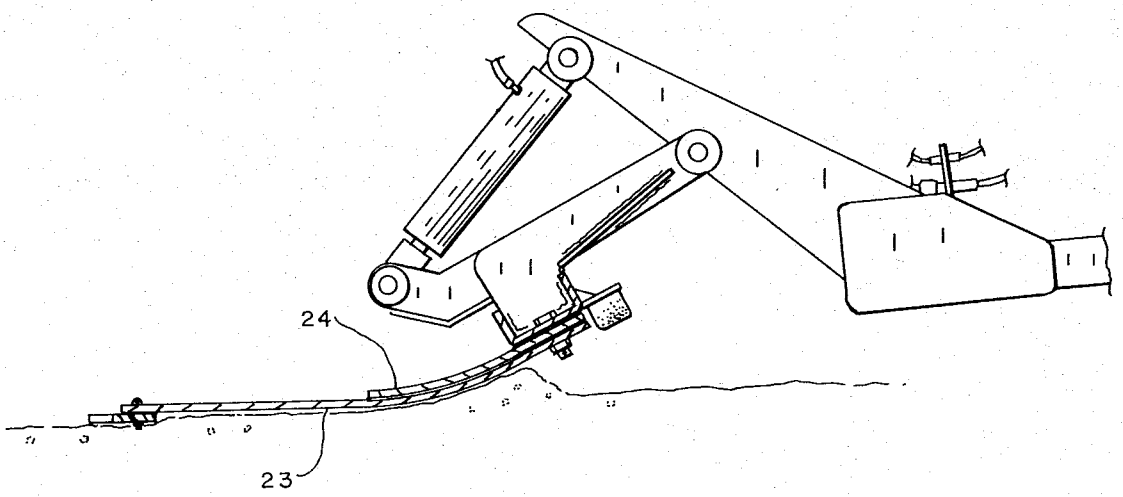
Figure 10:
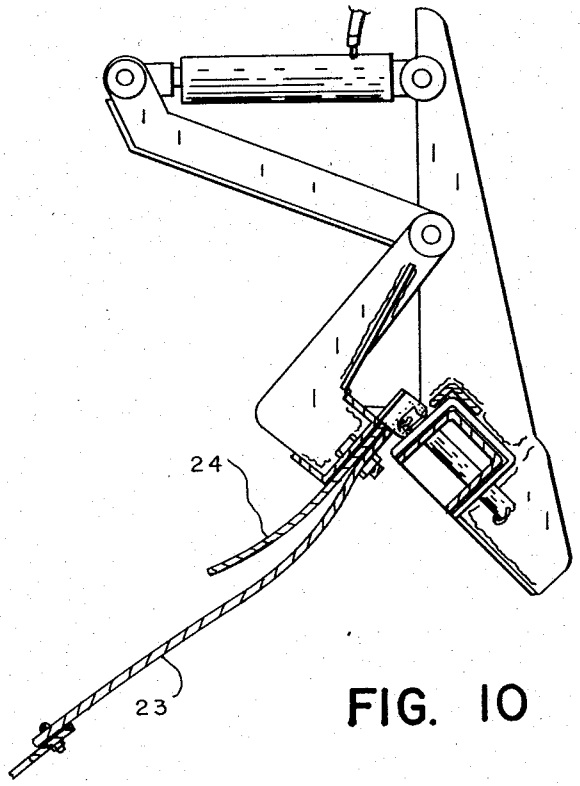

Sheets 23 and 24 may be pre-curved. (FIGS. 10 and 11 ) This tends to provide an appropriately curved, relatively rigid leading portion with less vertical force, so that the snow may be more gently compacted while still being effectively levelled.

Blade 22 could for example be of a single sheet, constructed with a thicker leading portion to provide the increased forward stiffness. While stainless steel is greatly preferred because snow will not adhere to it, and it is corrosion resistant, other steels, and other metals such as aluminum could be employed. Resilient plastic sheets could be used, although with less flexibility, durable resiliency, and general ruggedness than desired. The blade sheets are illustrated as monolithic from end to end, they could of course be constructed of shorter segments suitably secured together at their ends as by welding, riveting, or the like.

The invention may therefore be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed and desired to be secured by United States Letters Patent is:

1. An apparatus adapted to be drawn over a path of snow by a towing mechanism of a vehicle, to prepare the snow of the path for skiing, said apparatus comprising:

an elongate blade assembly having a surface adapted to contact the snow, said blade assembly including an elongate rigid leading edge member, an elongate flexible, snow-contacting sheet assembly having a leading edge and a trailing edge, said assembly including a sheet with a lowermost snow contacting surface and an opposite, uppermost surface, and a stack of at least one elongate sheet disposed upon said upper surface at the leading edge portion thereof, at least one of the sheets of said stack being substantially narrower than the lowermost snow contacting sheet, and means securing the sheet assembly at its leading edge to said rigid leading edge member;

means securing the leading edge member of the blade assembly to the towing mechanism of the vehicle.

2. The apparatus of claim 1, wherein:

the snow-contacting sheet assembly is adapted to provide snow-contacting surfaces of desired curvatures by only the force of gravity upon the snow from the mass of the apparatus and the mass of a vehicle towing mechanism pivotally secured to the vehicle.

3. The apparatus of claim 1, wherein:

the snow-contacting sheet is adapted to be forceably pressed onto the snow to provide snow-contacting surfaces of desired curvatures.

4. The apparatus of claim 1, wherein:

the sheets of the stack are of metallic material.

5. The apparatus of claim 1, wherein:

the sheets stack are of flexible resilient plastic material.

6. The apparatus of claim 4, wherein:

each blade sheet is planar in its unstressed configuration.

7. The apparatus of claim 4, wherein:

the leading portion of each blade sheet is pre-curved laterally in the backward direction its full length in its unstressed configuration.

8. The apparatus of claim 6, further comprising:

a pair of wing members each of substantially flexible resilient plastic material; and means securing one of the wing members to each end of the snow-contacting sheet so that the wing member extends outwardly from said sheet.

9. The apparatus of claim 7, further comprising:

a pair of wing members each of substantially flexible resilient plastic material; and means securing one of the wing members to each end of the snow-contacting sheet so that the wing member extends outwardly from said sheet.

10. The apparatus of claim 1, further comprising:

a snow-deflecting elongate sheet member secured at its lowermost edge upstanding from the leading edge member.

11. The apparatus of claim 1, wherein:

the means connecting the blade assembly to the vehicle towing mechanism includes pivot means about an axis parallel to the leading edge member, and remotely operable power means mounted to act between said connecting means and the blade assembly to pivot it about the pivot axis to adjust the angle between the sheet assembly and the surface of the snow.

12. The apparatus of claim 4, wherein:

the means connecting the blade assembly to the vehicle towing mechanism includes pivot means about an axis parallel to the leading edge member, and remotely operable power means mounted to act between said connecting means and the blade assembly to pivot it about the pivot axis to adjust the angle between the sheet assembly and the surface of the snow.

13. The apparatus of claim 5, wherein:

the means connecting the blade assembly to the vehicle towing mechanism includes pivot means about an axis parallel to the leading edge member, and remotely operable power means mounted to act between said connecting means and the blade assembly to pivot it about the pivot axis to adjust the angle between the sheet assembly and the surface of the snow.

14. The apparatus of claim 11, wherein:

the blade adjusting power means comprises hydraulic cylinder and ram means.

15. The apparatus of claim 12, wherein:

the blade adjusting power means comprises hydraulic cylinder and ram means.

16. The apparatus of claim 1, further comprising:

a retractable, blade-extending, wing assembly pivotally secured to at least one end of the blade assembly, including remotely controllable motor means for selective pivoting of said wing assembly into or out of snow-contacting position axially aligned with the blade assembly.

17. The apparatus of claim 4, further comprising:

a retractable, blade-extending, wing assembly pivotally secured to at least one end of the blade assembly, including remotely controllable motor means for selective pivoting of said wing assembly into or out of snow-contacting position axially aligned with the blade assembly.

* * * * *